US005342264A

United States Patent [19]

Gordon

[11] Patent Number: 5,342,264

[45] Date of Patent: Aug. 30, 1994

[54] AEROBIC EXERCISE DEVICE

[76] Inventor: Joel D. Gordon, 3311 Woodvalley Dr., Baltimore, Md. 21208

[21] Appl. No.: 21,064

[22] Filed: Feb. 23, 1993

[51] Int. Cl.[5] ..... A63B 69/18

[52] U.S. Cl. ..... 482/70; 482/51

[58] Field of Search ..... 482/51, 54, 70, 71, 482/148, 52, 53, 74, 121, 122, 123, 907

[56] References Cited

U.S. PATENT DOCUMENTS

| | | | |
|---|---|---|---|
| 3,941,377 | 3/1976 | Lie . | |
| 4,023,795 | 5/1977 | Pauls . | |
| 4,720,093 | 1/1988 | Del Mar . | |
| 4,781,372 | 11/1988 | McCormack | 482/70 |
| 4,867,443 | 9/1989 | Jensen . | |
| 4,993,704 | 2/1991 | Luczynski | 482/70 |
| 5,222,928 | 6/1993 | Yacullo | 482/51 |

FOREIGN PATENT DOCUMENTS

| | | | |
|---|---|---|---|
| 1049071 | 10/1983 | U.S.S.R. | 482/70 |

OTHER PUBLICATIONS

Pro-Form Cross Walk brochure, PROFORM Fitness Products, Inc., 1992.

Nordik Track "Fitness at Home" brochure, 1992, 28 pages.

*Primary Examiner*—Stephen R. Crow

[57] ABSTRACT

An aerobic exercise device provides for a smooth, natural, orbital continuous motion of the user's feet. This device can be used for walking, running, jogging or stair-stepping exercises. Upper body workout devices can be provided with the aerobic exercise device such that a total body workout can be had. The device includes two parallel tracks with platforms. The platforms reciprocate along the tracks. A device is provided in each track for returning the platforms to the home position. As a user operates the device, he or she will push the platforms rearwardly. When the user's foot reaches the end of his or her stride, the user can then lift their foot in a natural motion. The device will return the platform to the home position. As the platform is returning to the home position, it will first travel in a forward direction and then switch to a rearward direction. This rearward movement will enable comfortable planting of the user's foot as it reengages the platform. The device can be easily accommodated to any desired workout level or to many different sized users.

19 Claims, 5 Drawing Sheets

AEROBIC EXERCISE DEVICE

BACKGROUND OF THE INVENTION

Field of the Invention

The present invention relates to an aerobic exercise device which includes features of a cross-country ski exerciser and a manual treadmill.

DESCRIPTION OF THE BACKGROUND ART

Various exercise devices are known in the prior art. For example, conventional ski machines have a pair of foot slides which travel back and forth in fixed paths. These ski machines often have devices where the user can exercise his or her arms and legs. However, the problem with conventional ski machines is that the operator's foot is mounted on the foot slides. Therefore, the operator must slide his or her foot forwardly and rearwardly resulting in an uncomfortable, unnatural shuffle type of start-stop motion.

Treadmills are also known in the art. Most treadmills do not provide for exercise of the user's arms. Those prior art treadmills which do have a pair of arm levers really do not adequately exercise the arms. There is no hip pad on these machines and therefore appreciable resistance of the arms is not given. An adequate upper body work is not provided in other words.

Moreover, conventional treadmills when used in an automatic mode, rotate automatically. The operator is not forced to move the surface upon which he or she stands rearwardly thereby decreasing the amount of exercise which can be obtained when using the treadmill in the automatic mode.

Accordingly, a need in the art exists for a simple and effective aerobic exercise device which will enable the user to move their feet in a more natural, orbital continuous motion unlike the shuffling movement required with conventional ski machines. An aerobic exercise device is also needed which will enable the user to maximize his or her workout by exercising both their arms and legs with significant resistance and in a natural, familiar motion.

SUMMARY OF THE INVENTION

Accordingly, it the primary object of the present invention to provide an aerobic exercise device which will enable the user to move their feet in a more natural, continuous orbital motion.

It is a further object of the present invention to provide an aerobic exercise device which maximizes a user's workout by requiring the user to exert force to move the exercise platform rearwardly.

A further object of the present invention is to provide an aerobic exercise device which will exercise both the user's legs and arms to thereby provide a total body workout.

Still a further object of the present invention is to provide an aerobic exercise device which is adjustable for various sized users.

Yet another object of the present invention is to provide an aerobic exercise device which is comfortable to use and can be used in a walking, jogging, running or stepping mode.

Yet a further object of the present invention is to provide an aerobic exercise device which can smoothly and consistently be operated in a safe and comfortable manner.

Another object of the present invention is to provide an aerobic exercise device which is simple and inexpensive to manufacture and which requires only limited maintenance.

These and other objects of the present invention are fulfilled by providing an aerobic exercise device which comprises a pair of generally parallel tracks, a platform mounted on each of the tracks and means for independently moving each of the platforms in a generally forward direction. Each platform is reciprocated along the tracks. A user walking, running or jogging on the platform will move the platform in a rearward direction away from a home position. The means for moving will then automatically return the platforms to the home position when the user lifts their feet from the platform. Therefore there is no need for the user to shuffle his or her feet back to the home position. Rather, the user can lift their feet in a natural orbital movement. The means for moving will automatically return the platform to the home position when the user lifts their foot from the platform to return the platform to the home position. The aerobic exercise device will therefore be ready for the next rearward step of the user.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
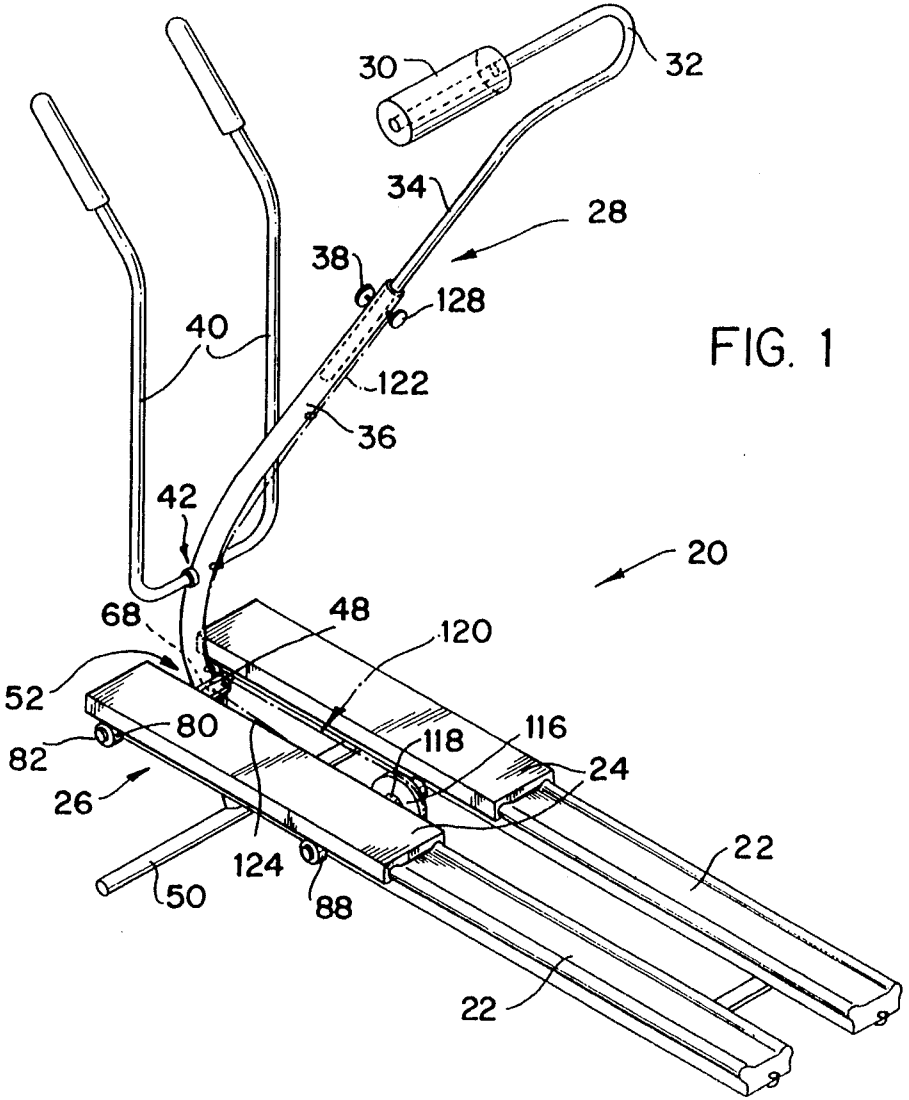
FIG. 1 is a perspective view of the aerobic exercise device of the present invention.

Referring in detail to the drawings and with particular reference to FIG. 1, an aerobic exercise device 20 is shown. This aerobic exercise device 20 includes a pair of generally parallel tracks 22. Mounted on each track 22 is a platform 24. Means 26 for moving each of the platforms 24 are provided. This means 26 will be described in greater detail below.

Figure 3:
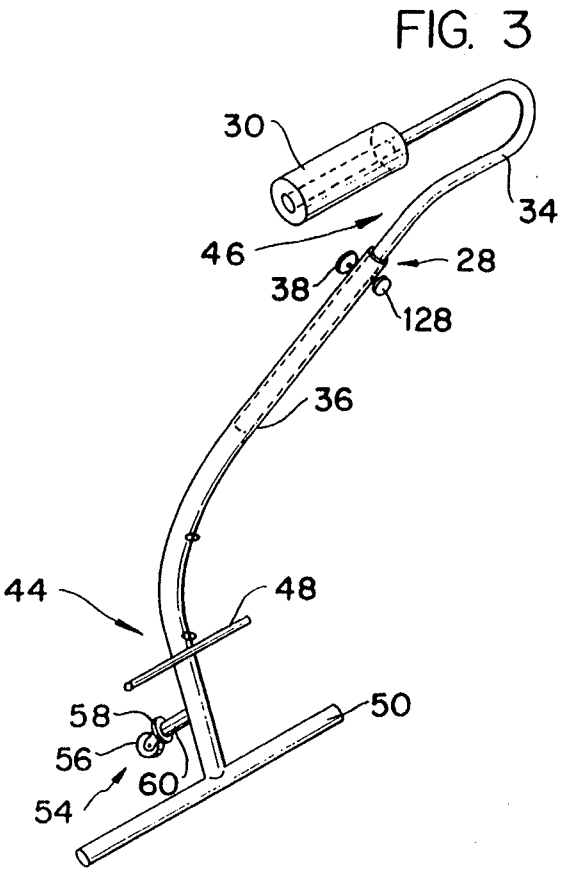
FIG. 3 is a perspective view of the mast of the present invention.

As seen in FIGS. 1 and 3, a mast 28 is provided. This mast 28 has a user engagement portion 30. The user engagement portion 30 freely rotates on the mast 28. This portion 30 can be removed from the mast so that the user can hold onto the mast. Otherwise, the body of a user can rest against this portion 30 during operation of the aerobic exercise device 20.

The upper portion 34 of the mast 28 has a curved section 32. Rather than using this curved section 32, it is possible for the mast to extend in a generally straight line to the user engagement portion 30. The mast 34 in such an arrangement would then be connected to a generally centrally located area of the user engagement portion 30. Beneath the upper portion 30 of the mast 28 is a lower portion 36. The upper and lower portion 34 can telescope in order to accommodate different heights of users. An adjustment knob 38 is provided for locking the portions 34, 36 of the mast 28 in position. It should be recognized, of course, that any suitable means for interlocking these mast portions can be of use. Additionally, a single, unitary, one-piece mast can also be used.

Attached to the mast 28 are two arms 40. These arms 40 are connected at connection means 42. The arms 40 are pivotable about an axis extending through connection means 42. Therefore, these arms 40 can move in a forward and rearward direction as the user operates the device 20. The tensioning of the connection means 42 can be changed in order to vary the amount of resistance for the arms 40. Therefore, the user can select a desired upper body workout level. By providing these arms 40, the user can swing his or her arms during operation of the device 20. A total body workout is thereby provided.

Figure 2:
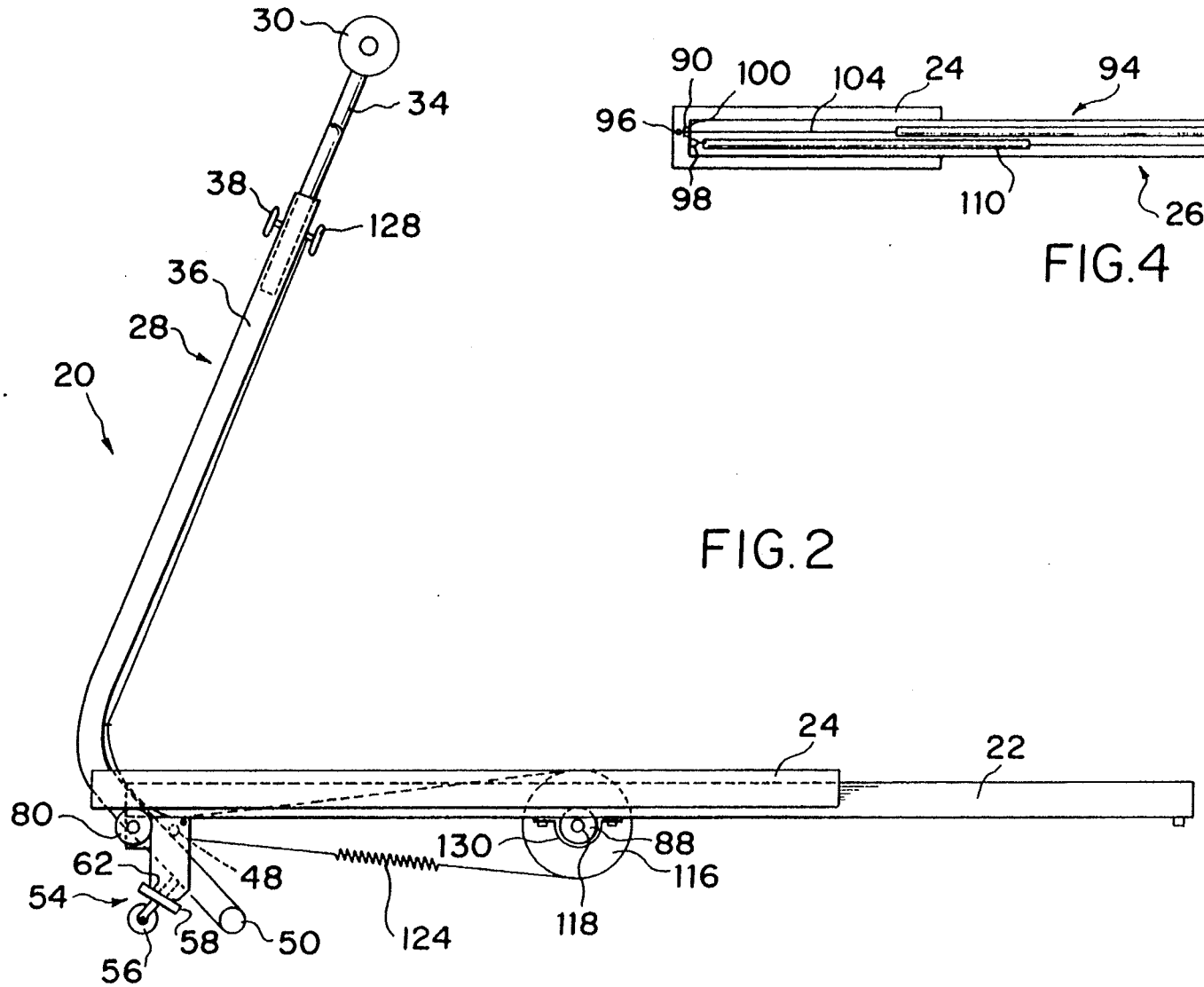
FIG. 2 is a side view of the aerobic exercise device of the present invention.

In FIGS. 2 and 3, the arms 40 and connection means 42 have been omitted for clarity. It can be seen in FIG. 3 that the mast 28 generally has an L-shape with a first portion 44 and a second portion 46. Connected to the first portion 44 is a rod 48 and support bar 50. This support bar 50 will rest on the ground when the mast 28 is in the first use position.

This first use position is shown in FIGS. 1 and 2. The mast 28 is pivotally supported in a support member 52. The details of this support member will be discussed with reference to FIG. 5 but the lower edge 62 of this member has been indicated in FIG. 2. The mast 52 pivots about an axis extending through rod 48 as will be described in more detail below. It should be appreciated that the support bar 50 is an over-center position in FIG. 2 such that the weight of the tracks 22 and platforms 25 will hold the mast 28 in position.

Figure 5:
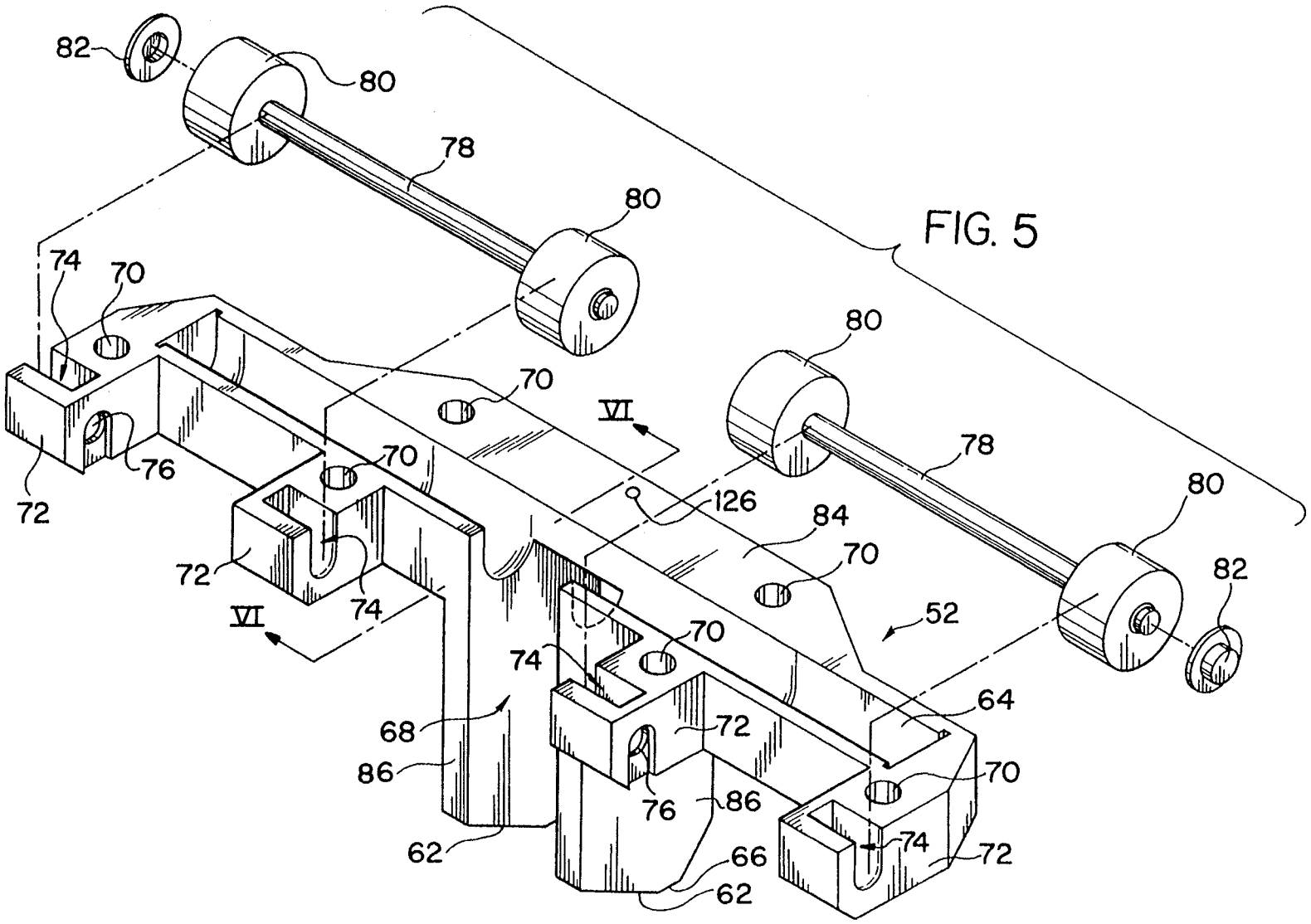
FIG. 5 is an exploded view of the support member of the present invention.

As seen in FIGS. 3, 2 and 5, a means 54 for engaging the support member 52 is provided on the mast 28. This means 54 for engaging comprises a control knob 56, adjustable washer 58 and member 60 extending between the washer 58 and first portion 44 of the mast 28. Member 60 can be a bolt passing through the first portion 44 of the mast 28 which bolt has a threaded screw portion on which the control knob 56 is rotatably mounted.

As seen in FIG. 2, the washer 58 will engage the lower edge 62 of the support member 52 when the device 20 is in the first use position. This support member 52 has a groove 64 as shown in FIG. 5 which receives the rod 48 connected to the mast 28. The rod 48 can pivot within this groove 64 in order to accommodate pivoting of the mast 28. The mast can move from the first use position shown in FIG. 2 to a second use position shown in FIG. 11. The mast is also movable to a storage position. In this storage position, the user engagement portion 30 would be adjacent the tracks 22.

To accommodate this pivoting movement of the mast 28, the control knob 56 is operated. This control knob 56 can be moved such that the washer 58 is loosened and moves away from the lower edge 62 of the support member 52. If the control knob 56 is adjusted sufficiently, the washer 58 can clear the lowermost edge 66 of the support member 52 to permit the mast 28 to pivot about the pivot axis extending through rod 48. The washer 58 will move past the lower edge 62 and the lowermost edge 66 of the support member 52 and the support bar 50 will engage a lower side of the track 22 in moving to the second use position (shown in FIG. 11). Alternatively, rather than pivoting the mast 28 to this second use position, the mast can be pivoted to the storage position when the control knob 58 is adjusted.

The support member 52 has a central opening 68 which receives the mast 28. Additional openings 70 are provided such that the support member 52 can be connected to the undersides of tracks 22. Three of the shown openings 70 will be connected to one track 22 while the other openings will be connected to the other track 22. Instead of screwing or bolting the support member 52 to the bottoms of the tracks 22, any suitable attachment arrangement can be used. It is merely necessary that the support member 52 be securely affixed to the tracks 22.

Forwardly extending portions 72 are provided on the support member 52. Grooves 74 with openings 76 are provided on these forwardly extending portions 72. Rods 78 can be positioned within these openings 76. On each end of the rod 78, a pair of rollers 80 are provided. Therefore, two pairs of rollers 80 are provided. These rollers 80 will engage a forward end of the under side of platforms 24 as indicated in FIG. 2. A push nut 82 is provided at the outermost side of each of the rods 78. These push nuts 82 will insure that the rollers 80 remain on the rod 78. Of course, these push nuts 82 can be omitted and any other suitable device used.

Figure 6:
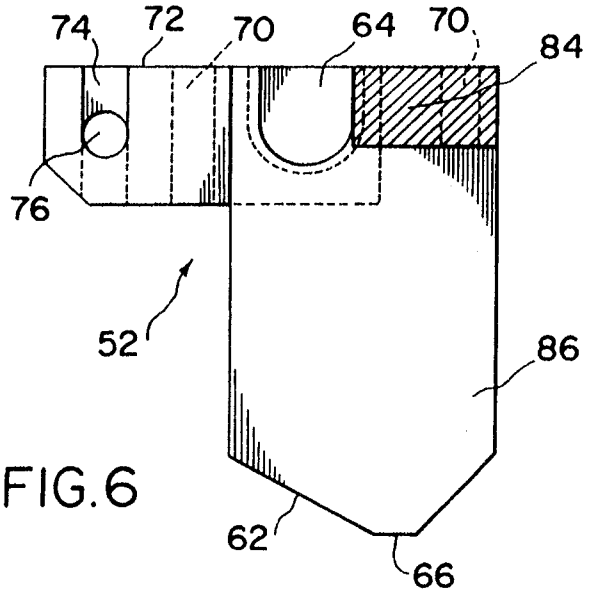
FIG. 6 is a section view taken along line VI—VI of FIG. 5.

A cross-sectional view of the support member 52 is shown in FIG. 6. The groove 64 in which the rod 48 is positioned and one of the opening 76 is shown. The horizontally extending portion 84 and the downwardly extending portion 86 of the support member 52 are also shown.

Figure 7:
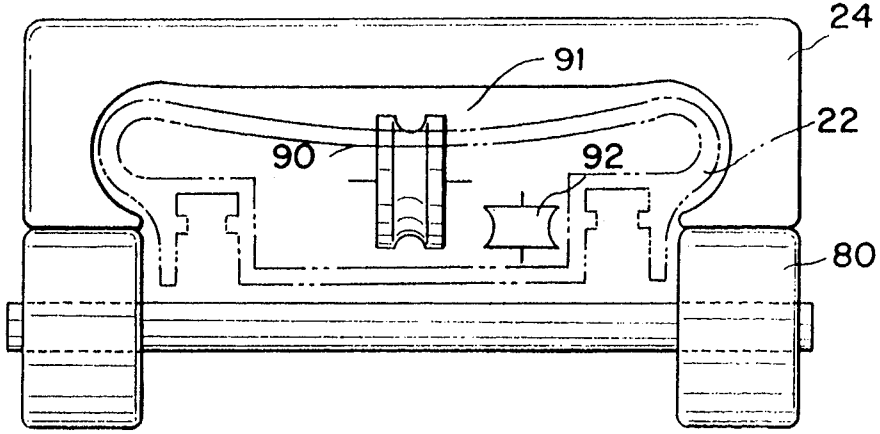
FIG. 7 is an end view showing one platform and roller arrangement of the present invention with the track shown in dotted lines.
Figure 8:
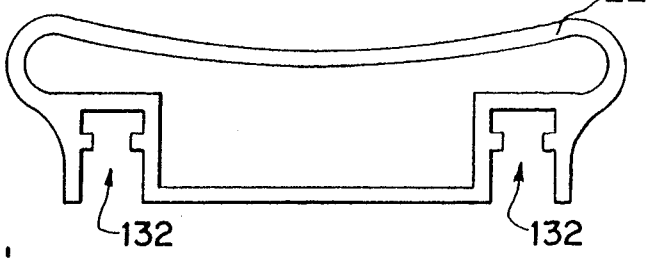
FIG. 8 is an end view of one track of the present invention.

Turning now to FIGS. 7 and 8, the configuration for the tracks 22 and platforms 24 can be seen. The bowed configuration for the tracks 22 is accommodated by the inner partially bowed shape of the platforms 24. A space 91 is provided between the track 22 and the platform 24 to accommodate a line 94 as will be described below. These platforms 24 can slide along the tracks 22 or can be solely supported by rollers. The rollers 80 indicated in FIG. 7 are the foremost rollers provided. A second set of wheels 88 are also provided for supporting the platforms as seen in FIG. 2. The operation of these wheels 88 will be described in detail below.

Instead of using rollers 80 and wheels 88, a lubricated track 22 can be used. Alternatively, the track can have Teflon TM or other waxy, opaque material which is used as a sliding coating. As another alternative, more than two sets of rollers and wheels can be provided. It is merely necessary that the platform 24 can be longitudinally reciprocated in a smooth fashion.

It is contemplated that the tracks 22 can be aluminum or plastic extrusion or any other suitable material. It is merely necessary that the track be rigid enough to allow repeated loading and unloading caused by an operator walking, running or jogging on the platform.

Within the platform 24 in FIG. 7, two pulleys 90 and 92 are indicated. The operation of these pulleys 90, 92 will now be described.

Figure 4:
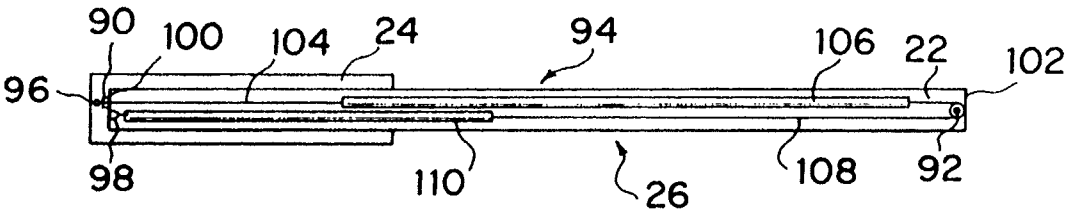
FIG. 4 is a bottom plan view of the platform, track and means for moving of the present invention.
Figure 9:
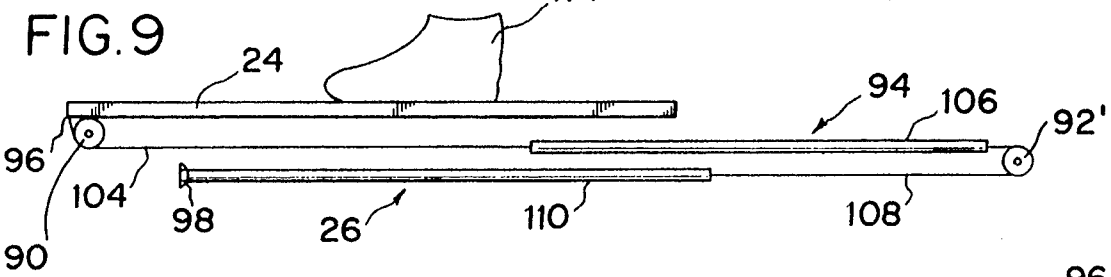
FIG. 9 is a schematic diagram showing the platform in the home position.
Figure 10:
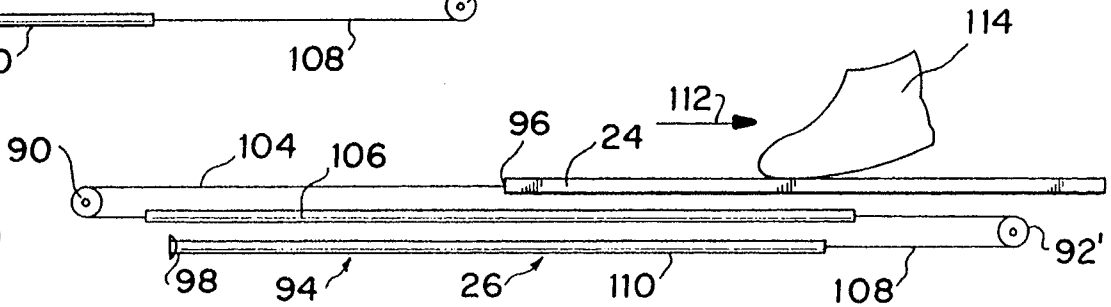
FIG. 10 is a schematic diagram showing the platform in a use position.

As seen in FIGS. 4, 9 and 10, one platform 24 is connected to a line 94. This line 94 acts as the means 26 for moving the platform. Each of the platforms 24 will have a line 94. The first end 96 of the line 94 is connected to the front of the platform 24. The second 98 of the line 94 is connected to the forward end cap 100 of the track 22. A rear end cap 102 is also provided on each track 22. These end caps 100, 102 are not indicated in FIGS. 7 and 8 for clarity.

The pulley 90 is mounted on the front end cap 100 while the pulley 92 is mounted on the rear end cap 102. As can be seen in FIG. 7, the pulley 90 protrudes above track 22 to enable the line 94 to extend through the gap 91 between the track 22 and platform 24. The line can smoothly move because it does not slide against the track 22 but reciprocates above the track 22. This line 94 will extend from its connection to the platform 24 at the first end 96, around pulley 90, above the track 22 to the second pulley 92 and then returned to the connection at the second end 98 at the forward end cap 100.

In FIGS. 9 and 10, the pulley 92' has been rotated 90° from the arrangement in FIG. 4. The orientation of this pulley has been changed in order to more clearly show the operation of the means 26 for moving the platforms. In other words, the pulley 92' rotates about a horizontal axis in FIGS. 9 and 10 instead of a vertical axis as shown in FIG. 7. In FIGS. 4, 9 and 10, the forward pulley 92 is shown as rotating about a horizontal axis. It should be appreciated that any orientation for the pulleys may be had. The arrangement shown in FIG. 4 has the advantage of providing for a more compact arrangement for the line 94.

A line 94 is made up of a first fixed length cord portion 104, a first stretch cord portion 106, a second fixed length cord portion 108 and a second stretch cord portion 110. The stretch cord portions 106, 110 are made from stretchable material. The stretch cords can be a bungy cord or other suitable material.

In FIG. 9, the platform 24 is shown in the home position. When a user 114 exerts a rearward force 112, the platform 24 will move from the home position to a position shown in FIG. 10. The exact location to which the platform 24 moves is variable depending upon the amount of force exerted by the user and the stride of the user.

The first end 96 of the line 94 will move rearwardly as indicated in FIG. 10. This will cause the stretch cord portions 106 and 110 to stretch as indicated in FIG. 10. This stretching exerts a forward force. It is therefore necessary for the user to exert force in order to counter the force and the stretch cord portions 106, 110 to move the platform 24 rearwardly. It should be appreciated that the fixed length cord portions 104, 108 do not change in their length. They are, as the name implies, of fixed length.

By providing two separate stretch cord portions 106 and 110, each individual stretch cord portion does not have to stretch beyond an acceptable limit. In other words, if only one stretch cord portion were provided, then it might be necessary to repeatedly stretch the cord beyond an acceptable limit such that the cord could loose its elasticity or be under unacceptable force. By providing two stretch cord portions, undue stretching of the stretch portions is avoided. Of course, depending upon the operation of the device, a single stretch cord portion could be provided, if so desired.

Returning now to FIGS. 1 and 2, it will be noted that a flywheel 116 is provided between the two generally parallel tracks 22. This flywheel 116 is mounted on an axle 118. On each side of each track 22, a wheel 88 is mounted. Of course, wheels can be mounted on only either the outer side of the track or the inner side of the track or can be omitted, if so desired.

A bracket 130 is provided on each side of each track 22 for holding the wheels 88, the axle 118 and the flywheel 116 in position. Two grooves 132 (shown in FIG. 8) are provided beneath each track 22 to receive a connection (such as a bolt) between the tracks 22 and the brackets 130. These grooves 132 will also receive a bolt or other suitable connector inserted through openings 70 to hold the support member 52 to the tracks. Of course, instead of using two brackets 130 for each track 22, a single bracket which engages one or both grooves 132 can be used. Any other suitable means can be used to connect the wheels 88 (if used), the flywheel 116 and the support member 52 to the aerobic exercise device 20.

Rearward motion of the platforms 22 will rotate the wheels 88 thereby rotating the flywheel 118. If it is desired to increase the workout of a user, the tension on the flywheel 118 can be adjusted by a tensioning means 120. This tensioning means includes a connection 122 which extends from the mast 28, beneath the support member 52, around the flywheel 116 and back to the support member 52. A hole 126 is provided on the support member for receiving one end of this connection 122. Along the connection 122, a spring 124 is provided.

Upon operating knob 128, the length of the connection 122 can be varied. If the length 122 is shortened, the spring will exert a greater force on the flywheel 116. It will therefore be more difficult to move the platforms 24 rearwardly. If, on the other hand, the knob 128 is moved to reduce tension on the flywheel, it will be easier to move the platforms 24 rearwardly. Accordingly a user can select the desired amount of force for his or her workout. The above-described aerobic exercise device 20 of the instant invention enables a user to walk, run or jog in a more natural movement. The user is not required to maintain his or her foot on the platform 24 while sliding the platform rearwardly and forwardly. Therefore, the instant aerobic exercise device 20 has advantages from that of the prior art. It is not necessary for the user to move in an unnatural, shuffle-like motion. Rather, the user's feet can move in a continuous, orbital motion. The user can therefore move naturally when walking, running or jogging on the device 20.

The means 26 for moving the platform will return the platform 24 to the home position when the user removes his or her foot from the rearwardly moved platform 24. The user exerts force to move the platform 24 rearwardly. The operator can then lift his or her foot from the platform 24. The stretch cord portions 106 and 110 will return to their unstretched length thereby moving the platform 24 back to the home position shown in FIG. 9.

Of course, a certain momentum will be created such that the platform 24 will move beyond the home position shown in FIG. 9. However, the connection of the line 94 to the platform 24 will result in centering of the platform 24 back to the home position. The momentum created by the forward moving platform 24 is absorbed by the stretch cord when the platform 24 is initially moving to the forward position. The stretch cord portions will bring the platform 24 to a momentary stop at which point the direction will change from the forward to the rearward motion. This point is forward of the home position. As the direction of movement of the platform becomes backward, the user's foot will again engage the platform 24. This initial rearward movement of the platform enables smooth operation of device 20. This backward movement of the platform allows the operator to comfortably plant his or her foot in either the walking, jogging or running mode.

It should be appreciated that while only one line 94 and platform 24 is shown and described in FIGS. 4, 9 and 10, that each track 22 will have a line 94 and platform 24 associated therewith.

Figure 11:
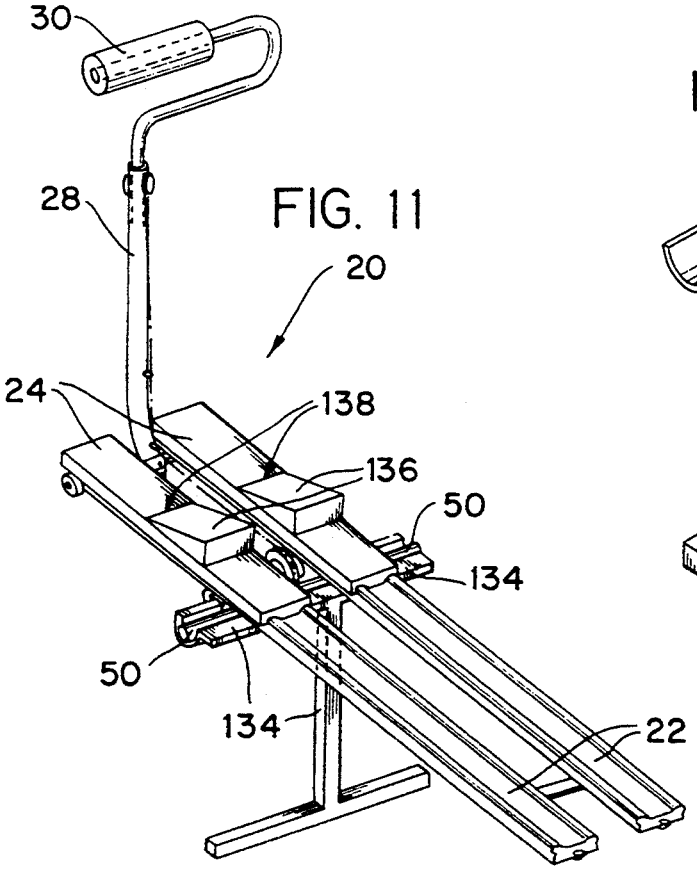
FIG. 11 is a perspective view of the aerobic exercise device of the present invention used in a stepping mode.
Figure 12:
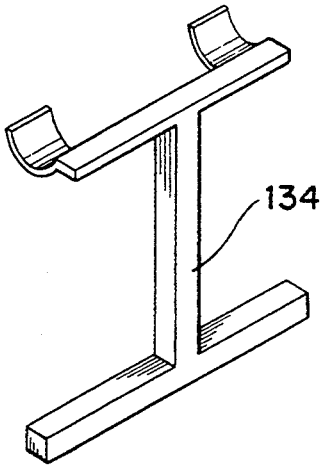
FIG. 12 is a perspective view of the stepper support of the present invention.
Figure 13:
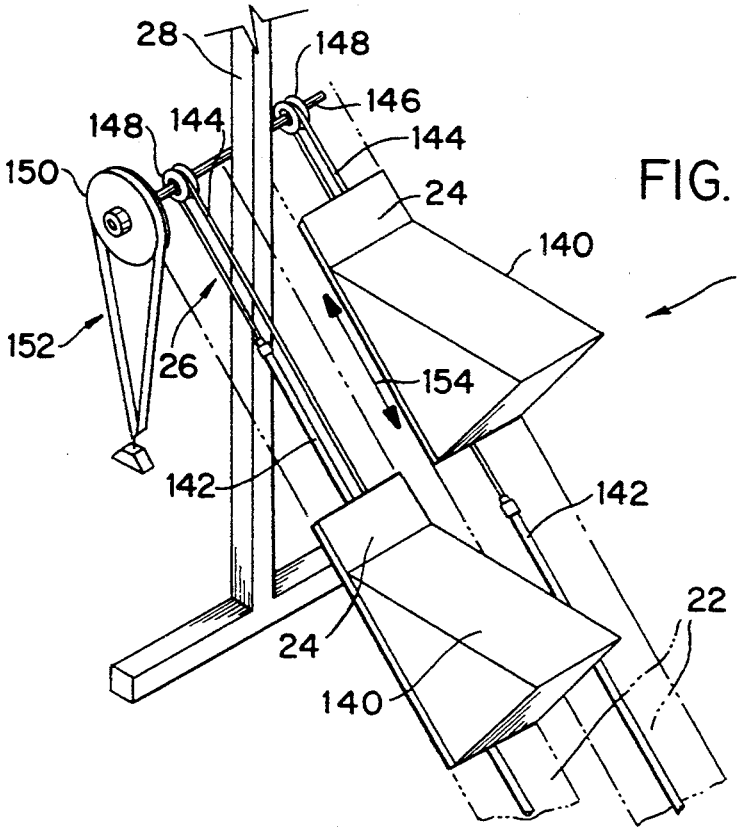
FIG. 13 is a modified form of the aerobic exercise device of the present invention used as a stepper machine.

The instant invention has additional advantages in that it can also be used as a step machine. As shown in FIGS. 11 and 12, a separate stepper support 134 is provided. This separate support 134 has a curved upper portion which will engage the support bar 50 of the mast 28. Before engaging the support bar 50, the mast 28 will be moved to the second use position as indicated in FIG. 11.

At any time during this operation, the detachable steps 136 can be mounted on each of the platforms 24. The upper surfaces 138 of these steps 136 are generally horizontal when the device 20 is on support 134. By stepping on the detachable steps 136, a user will move them rearwardly. When the weight of the user is removed from an individual step 136, the means for moving 26 will return the platform 24 and its associated step 136 to the home position.

Therefore by shifting the user's weight from foot to foot, a stepping motion can be had. Accordingly, the instant aerobic exercise device 20 can be used for walking, jogging, running or stair-stepping exercises.

A second embodiment 20' of the aerobic exercise device is shown in FIG. 12. This second embodiment is also a stepping machine like the arrangement shown in FIG. 11.

The steps 140 in this arrangement are permanently affixed to the platforms 24, but they could of course be detachable like the design in FIG. 11. The means 26 for moving the platform is also different in this device 20'. In particular, only a single stretch cord portion 142 and fixed length cord portion 144 are provided for each line of each platform 24. Of course, the double stretch cord portions and fixed length cord portions as described above could be used in this device 20'.

The stretch cord portion 142 is anchored at a lower end of the tracks 22. At an upper side of the tracks 22 an axle 146 is provided with two pulleys 148 for accommodating the fixed length cord portions 144. Mounted on this axle 146 is a flywheel 150. A tensioning means 152 is schematically shown in the flywheel 150. The resistance for rotation of the flywheel 150 can be varied by varying the weight on the tensioning means 152. Of course, any known arrangement can be used for adjusting the tensioning of this flywheel 150.

The aerobic exercise device 20' shown in FIG. 12 acts similarly to that device as shown in FIG. 11. The operator can shift his or her weight between the steps 140 in order to simulate stair climbing. Alternatively, if the tracks were positioned in a more horizontal orientation and the steps 140 were removed, this device could be used for walking, running or jogging similarly to the first embodiment.

On the mast 28, any suitable means can be provided whereby the user's arms can simultaneously be worked as the user climbs the steps. Therefore, a total body workout can be had with this aerobic exercise device 20'.

By providing the stretch cord portions 142, the steps 140 will return to their home position. The steps will move forwardly and rearwardly in the direction as indicated by arrow 154. After the steps 140 spring forwardly returning to their home position, there can be a downward movement similar to the arrangement described in the above embodiments. This will enable smooth operation of the device. Also, the operator is required to exert force against the stretch cord portions 142 in order to move the steps 140 rearwardly. This increases the aerobic exercise for the user.

The instant invention provides for an aerobic exercise device which allows a more natural continuous orbital movement of the user's feet. It is unnecessary to shuffle in a starting, stopping motion like conventional ski machines. The instant invention requires the user to exert force to move the platforms rearwardly thereby increasing his or her workout. By providing arms 40, the user can also workout their upper body.

The instant aerobic exercise device is suitable for different sized users. By simply adjusting the control knob 56, the tilt of the mast 32 can be easily varied. For example, a slight movement of the control knob 56 will move washer 58 but due to the length of the mast 28, a great degree of movement for the user engagement portion 30 will be had. Therefore, the instant device 20 can accommodate users of many different heights and weights.

When using the instant device 20, a smooth constant operation will be had which feels comfortable for the user. The user can quickly and easily vary his or her workout. Without any adjustments to the device 20, a user can go from walking, running or jogging.

The instant invention has the added advantage of being easily convertible to a stair stepping device. Any suitable arrangement can be provided for attaching the steps 136 to the arrangement shown in FIG. 11. Alternatively, the device 20' can continuously be used as a stair stepping machine as shown in FIG. 12.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed:

1. An aerobic exercise device comprising:

a pair of generally parallel tracks;

a platform mounted on each of the tracks, each platform being independently reciprocable along the track to which the platform is mounted, each of the platforms having a home position on the tracks, the platforms being moved in a first direction by a user away from the home positions, the platforms being engaged and disengaged by the user during operation of the aerobic exercise device for orbital type user foot motion; and elastic means for independently moving each of the platforms in at least a second direction when the platform is disengaged by the user, the second direction being opposite the first direction whereby the platform is momentarily returned beyond the home position after the user moves the platform and then disengages the platform.

2. The aerobic exercise device as recited in claim 1, wherein the means for moving comprises a line attached to each of the platforms, the line including at least one stretch cord portion and at least one fixed length cord portion, the stretch cord portion being stretched when the platform attached thereto moves away from the home position.

3. The aerobic exercise device as recited in claim 2, wherein the line has a first end and a second end, the line also has a first stretch cord portion, a second stretch cord portion, a first fixed length cord portion and a second fixed length cord portion, the first end of the line being attached to the platform, the first fixed length cord portion being at the first end of the line, the first stretch cord portion being attached to the first fixed cord portion, the second fixed length cord portion being between the first and second stretch cord portions and the second stretch cord portion being at the second end of the line.

4. The aerobic exercise device as recited in claim 3, further comprising end caps on each end of each track, the tracks having a forward end and a rearward end, the home positions for the platforms being at the forward ends of the tracks, each of the end caps on the forward ends of the tracks having an opening defined therein, the first fixed length cord portion extends from the platform, through the opening and to the first stretch cord portion for each of the lines, the end caps on the rearward ends of the tracks having a pulley mounted thereon, the second fixed length cord portion extends around the pulley for each of the lines and the second stretch cord portion extends from the second fixed length cord portion to the end cap at the forward end of the track.

5. The aerobic exercise device as recited in claim 1, wherein the platforms have a generally flat upper surface without any user engageable enclosures thereon.

6. The aerobic exercise device as recited in claim 1, further comprising a mast mounted between the two tracks, the mast being pivotable and having a generally L-shaped configuration with first and second ends, the first end having a support bar affixed thereto, the support bar engaging the ground when the mast is in a first use position, the tracks being inclined when the mast is in the first use position and the support bar engages the ground.

7. The aerobic exercise device as recited in claim 6, wherein the mast has a first and second portion due to the L-shape configuration, the support bar being affixed to the first portion of the mast and the aerobic exercise device further comprising a rod affixed to the first portion of the mast, the rod being spaced from the support bar and extending generally parallel to the support bar, the mast being connected to the tracks by the rod and the mast being pivotable relative to the tracks about a pivot axis extending through the rod.

8. The aerobic exercise device as recited in claim 7, further comprising a support member, the support member having a groove provided therein, the rod of the mast being insertable in the groove and the rod being movable in the groove as the mast pivots, the support member being mounted to each of the tracks with the mast being positioned between the tracks.

9. The aerobic exercise device as recited in claim 8, wherein the support member has a lower edge and wherein the mast has means for engaging the lower edge of the support member to hold the mast in position.

10. The aerobic exercise device as recited in claim 9, wherein the means for engaging the lower edge of the support member comprises an adjustable washer mounted to the mast and a control knob, the control knob being operable to move the washer toward and away from the mast, the control knob moving the washer away from the mast when the mast is to move from the first use position such that the washer is disengaged from the lower edge of the support member.

11. The aerobic exercise device as recited in claim 10, further comprising two pairs of rollers mounted on the support member, each of the tracks having one roller pair adjacent thereto and the roller pairs being engagable with the platform on the track, the platforms sliding over the rollers as the platforms move to and from the home position.

12. The aerobic exercise device as recited in claim 11, wherein the tracks have a forward end and a rearward end, the home positions for the platforms being at the forward ends of the tracks, the aerobic exercise device further comprising a flywheel, an axle and at least two wheels, the flywheel being positioned between the tracks rearwardly of the support member, the axle passing generally through the center of the flywheel and at least one of the wheels being positioned on each side of the flywheel, the wheels being engageable with the platforms, the platforms sliding over the wheels as the platforms move to and from the home positions, movement of the platforms in the second direction moving the wheels and rotating the flywheel.

13. The aerobic exercise device as recited in claim 12, further comprising tensioning means for adjusting tensioning of the flywheel, adjustment of tensioning of the flywheel varying a force required to move the platforms in the second direction.

14. The aerobic exercise device as recited in claim 13, wherein the tensioning means comprises a connection extending from the second portion of the mast, past the support member, around the flywheel and back to the support member, the connection includes a spring positioned between the support member and the flywheel.

15. The aerobic exercise device as recited in claim 1, further comprising a support member and two pairs of rollers, the support member being mounted to each of the tracks and the two pairs of rollers being mounted on the support member, each of the tracks having one roller pair adjacent thereto and the roller pairs being engagable with the platform on the track, the platforms sliding over the rollers as the platforms move to and from the home position.

16. The aerobic exercise device as recited in claim 1, wherein the tracks have a forward end and a rearward end, the home positions for the platforms being at the forward ends of the tracks, the aerobic exercise device further comprising a flywheel, an axle and at least two wheels, the flywheel being positioned between the tracks rearwardly of the support member, the axle passing generally through the center of the flywheel and at least one of the wheels being positioned on each side of the flywheel, the wheels being engageable with the platforms, the platforms sliding over the wheels as the platforms move to and from the home positions, movement of the platforms in the second direction moving the wheels and rotating the flywheel.

17. The aerobic exercise device as recited in claim 1, further comprising tensioning means for adjusting tensioning of the flywheel, adjustment of tensioning of the flywheel varying a force required to move the platforms in the second direction, the tensioning means comprises a connection extending at least from the support member, around the flywheel and back to the support member, the connection includes a spring positioned between the support member and the flywheel.

18. The aerobic exercise device as recited in claim 1, further comprising a detachable step for each of the platforms, the steps being mountable on and readily detachable from the platforms, the steps having a generally triangular configuration with an upper surface being engageable by the user, the tracks being inclined during use when the steps are mounted on the platforms such that the upper surfaces of the steps are generally horizontal, the platforms being movable in the second direction by the user and being returned to the home position by the means for moving when the steps are mounted on the platforms.

19. The aerobic exercise device as recited in claim 18, wherein the tracks have a forward end and a rearward end, the home positions for the platforms being at the forward ends of the tracks, the aerobic exercise device further comprising a support member, a stepper support and a mast, the support member being mounted to each of the tracks and the mast being pivotally mounted to the support member and being positioned between the two tracks, the mast being pivotable between at least a first use position and a second use position, the tracks being inclined at a first angle when the mast is in the first use position and at a second angle when the mast is in the second use position, the stepper support being detachably mounted to the support member when the mast in the second use position to raise the forward end of the tracks, the second angle being greater than the first angle such that the tracks are more inclined when the stepper support is used, the detachable steps being mounted on the platforms when the stepper support is mounted to the support member and when the aerobic exercise device is used.

* * * * *